US006015130A

United States Patent [19]

Kigel

[11] Patent Number: 6,015,130

[45] Date of Patent: Jan. 18, 2000

[54] LEAK-PROOF HYDRAULIC DEVICE FOR SUPPORTING A BARBER'S CHAIR

[76] Inventor: Rudolf Kigel, 50 Ritin Lane, Unit 6, Concord, Ontario, Canada, L4K 4C9

[21] Appl. No.: 09/062,687

[22] Filed: Apr. 20, 1998

[51] Int. Cl.[7] ..... F16M 13/00

[52] U.S. Cl. ..... 248/631; 60/477; 248/404; 297/71; 417/443

[58] Field of Search ..... 248/631, 400, 248/404, 188.2, 161, 157; 60/477, 481, 482; 297/347, 71, 330, 90, 80, 188

[56] References Cited

U.S. PATENT DOCUMENTS

| | | | |
|---|---|---|---|
| 972,859 | 10/1910 | Hornung | 297/71 |
| 1,347,264 | 7/1920 | Emmert | 297/71 |
| 1,455,223 | 5/1923 | Paoli | 91/402 |
| 2,254,084 | 8/1941 | Nilson | 417/443 |
| 2,393,405 | 1/1946 | Page | 60/481 |
| 3,140,892 | 7/1964 | Shubart et al. | 297/80 |
| 3,311,407 | 3/1967 | Horie | 297/71 |
| 3,368,845 | 2/1968 | Watanabe | 106/504 |
| 3,711,054 | 1/1973 | Bauer | 248/400 |
| 3,763,651 | 10/1973 | Okiyama | 60/477 |
| 3,959,970 | 6/1976 | Bos et al. | 60/477 |
| 4,048,800 | 9/1977 | Cancilla | 60/477 |
| 4,108,416 | 8/1978 | Nagase et al. | 248/400 |
| 4,136,908 | 1/1979 | Crayne | 297/188 |

*Primary Examiner*—Ramon O. Ramirez
*Assistant Examiner*—Tan Le
*Attorney, Agent, or Firm*—David W. Wong

[57] ABSTRACT

The hydraulic device for raising and lowering seat of the barber's chair has a main housing section and a lower section. A sliding plunger is slidably mounted in a sleeve extending between the lower section and the top cover of the main housing section. An oil pump is operative to force the oil contained with the main housing section into a channel in the lower section to the bottom of the sleeve for raising or lowering the sliding plunger. The seat of the barber's chair is mounted to the top of the sliding plunger. The joint between the lower section and the main housing section is permanently sealed with a metal compound by welding, brazing or soldering.

5 Claims, 3 Drawing Sheets

LEAK-PROOF HYDRAULIC DEVICE FOR SUPPORTING A BARBER'S CHAIR

BACKGROUND OF THE INVENTION

This invention relates to a hydraulic device for barber's chair and the like.

A hydraulic device is commonly used for raising and lowering the seat of a barber's chair. The hydraulic device is cylindrical and forms a part of the support column for the seat of the chair. The seat is mounted onto the top portion of a sliding plunger of the device which has an elongated cantilever that may be operated by pivoting it up and down in a pumping action such that the sliding plunger would extend upwards slowly for raising the seat upwards accordingly. The hydraulic device has a cylindrical main housing section and a lower section. The main housing section is filled with operating oil; and the pumping action is to force the oil in the main housing section to move into the lower section and through an internal channel therein to thrust the sliding plunger upwards. The seat may be lowered slowly from the raised position by pressing on the operating lever so as to open a release valve therein to allow the oil in the lower section to return to the main housing section slowly, to lower the plunger and, in turn, lowering the seat accordingly. The lower section of the device is commonly mounted to the bottom of the main housing section with bolts and an O-ring is provided in the upper portion of the lower section to seal the joint formed by this upper portion engaging with the lower portion of the main housing section. The O-ring is intended to ensure the sealing of the joint to prevent the leakage of oil therethrough. However, due to fabrication tolerances of the different component parts and the unsatisfactory mounting force provided by the mounting bolts, it has been a plaguing problem with the leakage of oil through the joint. The oil leaked from the hydraulic device onto the floor of the barber shop presents a safety hazard to the barber and the customers since they may slip and fall on the oily floor. The leaked oil would also contaminate the environment; and would, in fact, eventually lead to the failure of the device due to insufficient amount of oil remaining in the pump. Furthermore, the rubber O-ring used in ensuring the sealing the joint inherently deteriorates with the exposure to the oil and resulting in the complete failure of the sealing provision of the joint.

Moreover, an additional circular groove must be formed at the upper portion of the lower section for retaining the O-ring in place. The formation of such circular groove requires further precision fabrication steps in the manufacturing of the lower section.

SUMMARY OF THE INVENTION

It is a principal object of the present invention to provide a hydraulic device in which the main housing section and the lower section are permanently mounted together such that no leakage of the oil would occur through the joint between the two sections.

It is another object of the present invention to provide a hydraulic device in which sealing rubber O-ring is not used.

Briefly, the hydraulic device for raising and lowering the seat of a barber's chair and the like of the present invention comprises a main housing section adapted to house the operating oil for the device. The main housing section has a top cover. A lower section is adapted to be mounted to the bottom of the main housing section. The lower section has an upper portion with a smooth surface and a diameter equal to the inner diameter of the bottom of the main housing section and adapted to engage and mate intimately with the main housing section to form a snug-fitted circular joint. A metallic sealing compound is permanently applied at the circular joint to eliminate leakage of the oil therethrough as well as securing the two sections fixedly together. The sealing compound may be applied by welding, or brazing, or soldering.

BRIEF DESCRIPTION OF THE DRAWINGS

Other objects of this invention will appear in the following description and appended claims, reference being made to the accompanying drawings in which

DETAILED DESCRIPTION OF THE INVENTION

Figure 1:
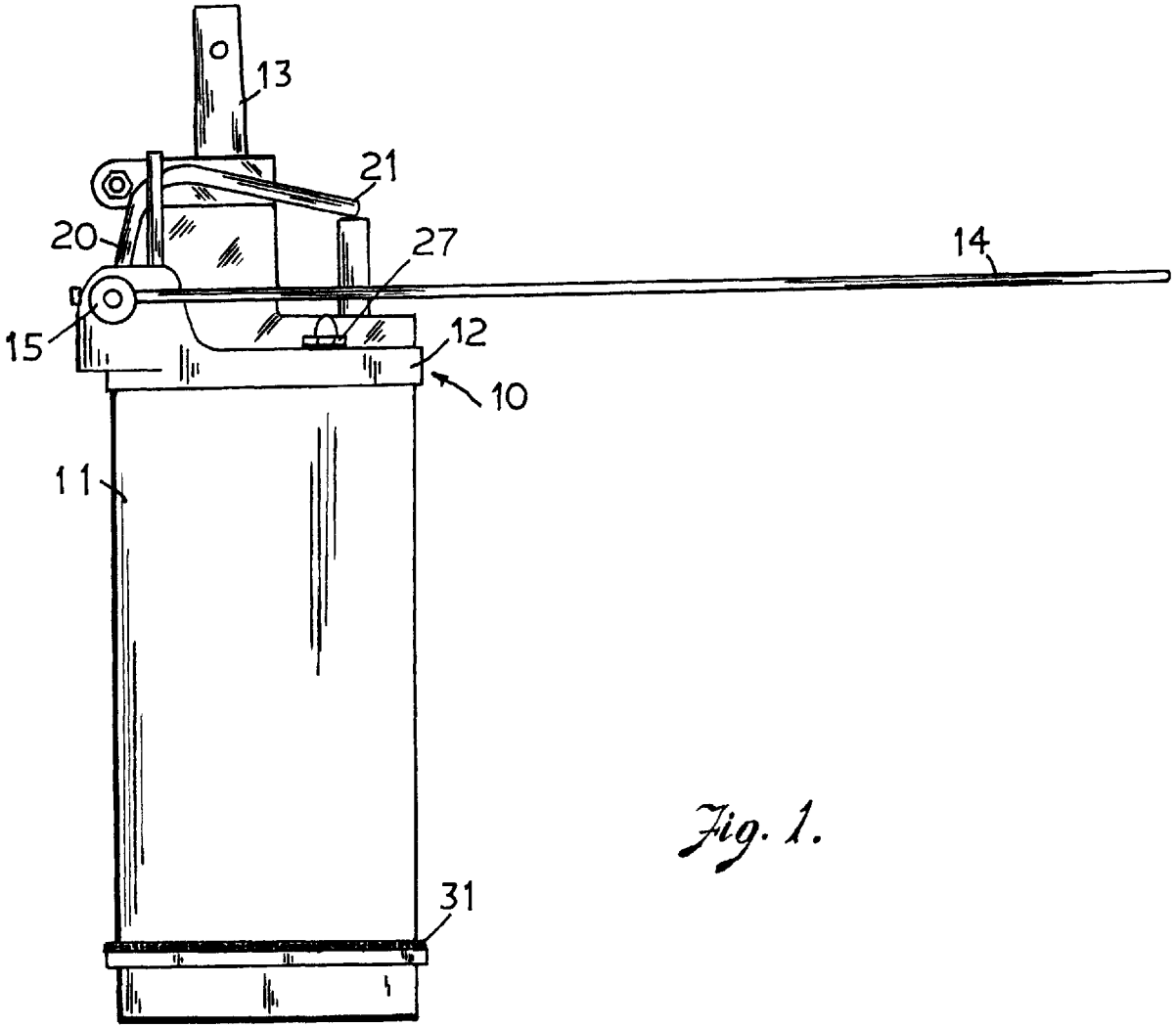
FIG. 1 is an overall perspective side elevation view of the hydraulic device according to the present invention.

With reference to the drawings wherein like reference numerals designate corresponding parts in the several views, the hydraulic device 10 has a cylindrical main housing section 11 with a top cover 12. A sliding plunger 13 is slidably mounted to the device through its top cover 12. An elongated operating arm 14 is mounted to a rotatable shaft 15 which is rotatably mounted to the top cover 12 by two upstanding blocks 16 and 17 and secured in place by two bolts 18 and 19 respectively. An U-shaped arm 20 is mounted on the middle portion of the rotatable shaft 15. The U-shaped arm 20 has a cross section 21 normally resting on top of the reciprocating plunger 22 of the pump operative for pumping the oil from the main housing section 11 through a filter 23 into a channel in the lower section 24. This channel communicates with a sleeve 25 which extends from the lower section 24 to the top cover 12. The inside of the sleeve 25 does not communicate with the interior of the main housing section 11. The sliding plunger 13 is intimately and slidably mounted inside the sleeve 25 such that when the oil is pumped through the channel in the lower section 24 into the bottom of the sleeve 25, the oil will force the sliding plunger 12 to rise upwards. The seat of the barber's chair (not shown) is mounted to the top of the sliding plunger 13. The pump plunger 22 of the pump is biassed by a compressing spring 26 which operates to return the pump plunger 22 to the upper normal position.

Figure 2:
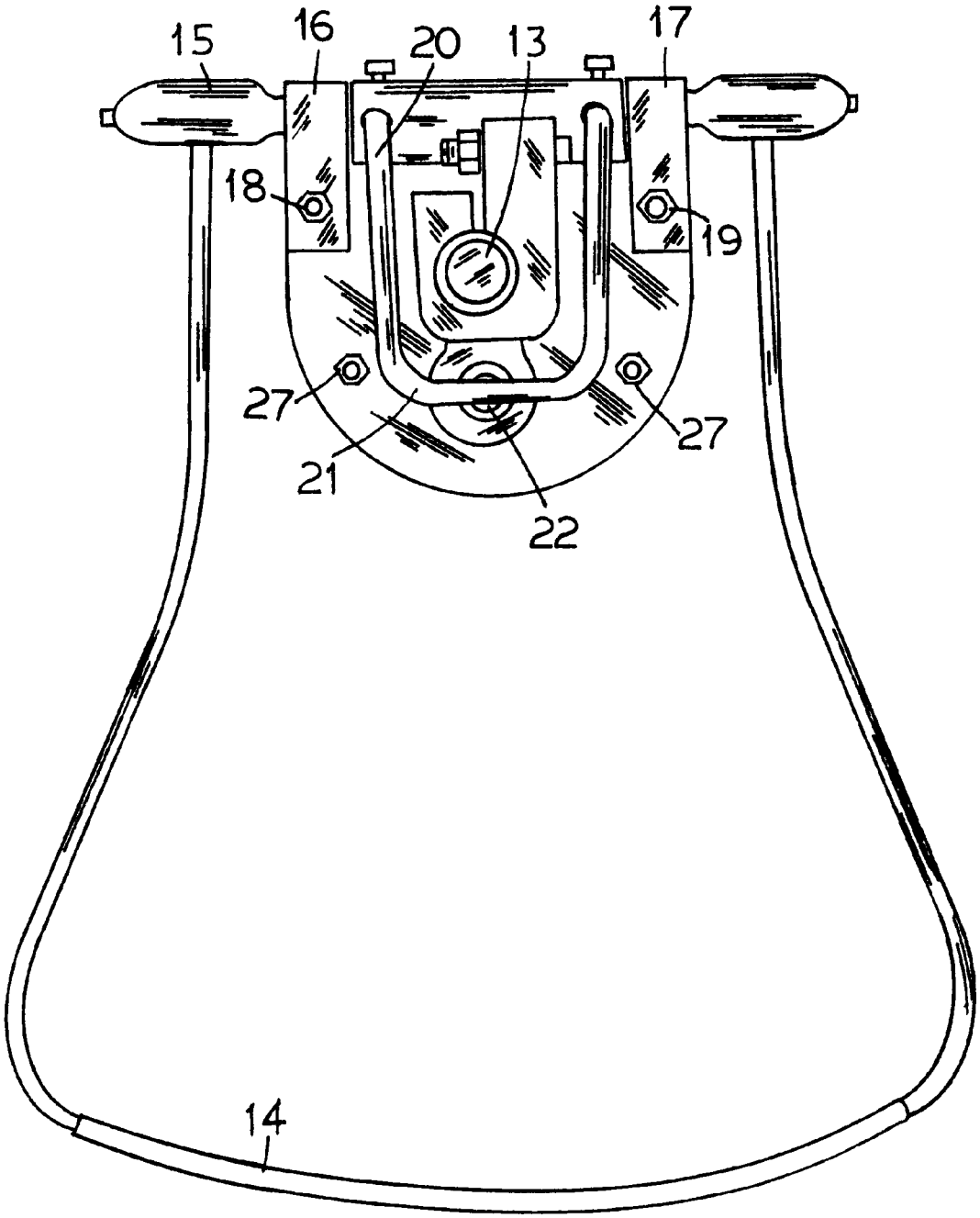
FIG. 2 is the top elevation view thereof.
Figure 3:
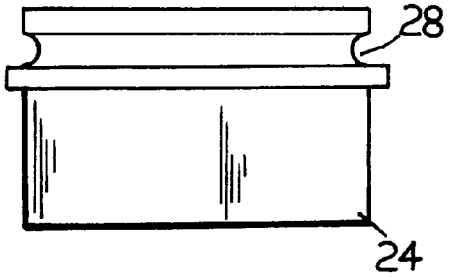
FIG. 3 is an isolated side view of the lower section of a conventional hydraulic device showing the provision of a circular groove for the sealing O-ring.
Figure 4:
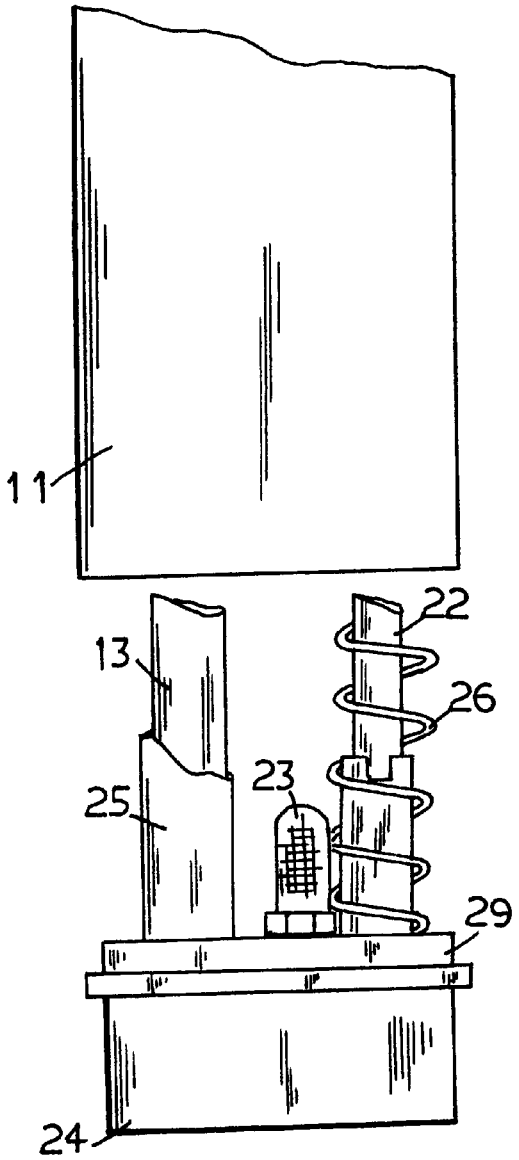
FIG. 4 is an isolated side exploded elevation view of the lower section of the device according to the present invention.

FIG. 3 shows a lower section 24 of a conventional hydraulic device which is secured to the main housing section 11 by elongated bolts partially shown in FIGS. 1 and 2 extending from the top cover 12 to engage with the lower section 24. A circular groove 28 must be formed in the lower section 24 for mounting a rubber O-ring thereto. The joint between the main housing section 11 and the lower section 24 in such conventional hydraulic device solely depends on such rubber O-ring and the pulling force of the elongated bolts 27 exerted on the lower section 24. Such mounting force and the rubber O-ring have not provided a satisfactory seal for the joint and the oil in the main housing section 11 has always leaked through such joint.

The upper cylindrical portion 29 of the lower section 24 in the hydraulic device 10 according to the present invention has smooth surface and a diameter equal to the inner diameter of the bottom portion of the main housing section 11, such that the two sections engage and mating with each other intimately. The circular joint between the two sections is further sealed permanently by welding, or brazing or soldering 30 with a metal compound 31 as best shown in FIG. 1, such that no leakage of oil can occur through the joint. The sealing compound or weld also secures the lower section 24 permanently to the main housing section 11. Since the interior of the main housing section 11 may still be accessible after assembly by removing the top cover 12, it is not necessary to remove the lower section 24 for repair and/or maintenance of the device. Furthermore, since the weld, braze, or solder may be formed without the same precision as the formation of the circular groove for the sealing O-ring as in the conventional device, the device may be fabricated quickly and easily.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

I claim:

1. A hydraulic device adapted for permanent mounting of a barber's chair and operative for raising and lowering the seat of said barber's chair permanently mounted on top of a sliding plunger therein, comprising a circular cylindrical main housing section adapted for housing operating oil for said device and operative for raising and lowering said sliding plunger, said main housing having a top cover and a circular bottom opening having an inner diameter, a circular cylindrical lower section adapted to be mounted to said main housing section, said lower section and said main housing having an equal outside diameter, and said lower section having an upper portion provided with a smooth circular surface and a diameter equal to said inner diameter of said circular bottom opening of said main housing section and adapted for insertion engagement with said circular bottom opening of said main housing section to form a snug-fitted circular joint therebetween having an exposed circular joint line, a metallic sealing compound permanently applied over the entirety of said circular joint line.

2. A hydraulic device according to claim 1 wherein said sealing compound is applied to the entirety of said joint by welding.

3. A hydraulic device according to claim 2 wherein said sealing compound is a weld applied to the entirety of said joint by welding.

4. A hydraulic device according to claim 1 wherein said sealing compound is a braze applied to the entirety of said joint by brazing.

5. A hydraulic device according to claim 1 wherein said sealing compound is applied to the entirety of said joint by soldering.

* * * * *